US005269516A

United States Patent [19]

Janes

[11] Patent Number: 5,269,516

[45] Date of Patent: Dec. 14, 1993

[54] RACQUET HANDLE

[75] Inventor: Richard Janes, Scottsdale, Ariz.

[73] Assignee: GenCorp Inc., Fairlawn, Ohio

[21] Appl. No.: 815,109

[22] Filed: Dec. 30, 1991

[51] Int. Cl.[5] ..... A63B 49/08

[52] U.S. Cl. ..... 273/73 J; 273/75; 273/81 R; 273/81 B; 273/67 R

[58] Field of Search ..... 273/73 J, 75, 81 R, 273/81 B, 67 R, 67 A, 67 B, 67 C, 67 D, 67 DA, 72 R

[56] References Cited

U.S. PATENT DOCUMENTS

| | | | |
|---|---|---|---|
| 2,103,889 | 12/1937 | Brisick | 273/81 B |
| 2,280,382 | 4/1942 | Davis | 273/75 |
| 3,702,701 | 11/1972 | Vaughn et al. | 273/73 H |
| 4,072,312 | 2/1978 | Kahn | 273/75 |
| 4,984,793 | 1/1991 | Chen | 273/75 |
| 4,989,870 | 2/1991 | Janes | 273/73 J |
| 5,088,734 | 2/1992 | Glava | 273/73 J |

FOREIGN PATENT DOCUMENTS

| | | | |
|---|---|---|---|
| 651817 | 4/1951 | United Kingdom | 273/81 R |

*Primary Examiner*—V. Millin
*Assistant Examiner*—Raleigh W. Chiu

[57] ABSTRACT

A handle pallet for a tennis racquet includes an elongated rigid underlayment member formed integrally with the racquet head in a one-step compression molding operation, to form a one-piece racquet head/handle pallet underlayment member article. The underlayment member generally is octagonal-shaped, and includes sides having a concave-shaped exterior surface and sides having a flat exterior surface, with the widths of the sides being generally uniform. Spaced elongated edges of the sides form prominent, outwardly directed ridges at each interface of pairs of said edges for indexing of the racquet orientation by the player. An elongated soft overlayment member also is octagonal-shaped and is disposed on the underlayment member for shock absorption. The sides of the overlayment member each have a flat exterior surface, and the interior surface of the overlayment member is complementary in shape to the exterior surface of the underlayment member. The width of the overlayment member is variable due to the concave-shaped sides of the underlayment member, so that the handle pallet is lightweight and maintains the indexing function of the underlayment member, yet provides excellent shock absorbency for the player.

20 Claims, 5 Drawing Sheets

RACQUET HANDLE

FIELD OF THE INVENTION

The present invention relates to racquet handles, and in particular to a tennis racquet handle. More specifically, the present invention relates to such a tennis racquet handle which exhibits an improved combination of light weight, shock absorption and indexing.

BACKGROUND

Heretofore, modern tennis racquet handles typically have been formed of a pre-molded hard composite material during the racquet compression molding operation. The pre-molded handle then is placed into a mold which defines the finished handle pallet dimensions. The material utilized in forming the handle pallet usually has been a rigid cell-type polyurethane foam which was introduced into the handle pallet mold cavity via a low pressure cast molding type machine. This process produced a handle pallet which was relatively heavy so that only approximately 10–20 grams of lead was necessary to be added to the handle before the injection of the polyurethane foam during the molding operation, in order to conform to conventional head light balance condition specifications. The resulting handle pallet was reasonably hard, having a Shore D hardness of about 40. This rigidity was beneficial in that the edges of the eight-sided or transverse cross-sectional, octagonal-shaped handle pallet were hard and clearly defined even when covered with a leather or synthetic material grip, so that indexing the orientation of the tennis racquet face via manipulation of the handle by the player's hand was facilitated. However, such tennis racquet handles exhibited poor shock absorption and would be too heavy for head heavy balance condition specifications.

In recent years, a modified handle pallet has been developed in which a softer, more elastic material has been molded and slipped on the hard handle pallet structure described immediately above. Such handle pallets generally are very shock absorbent due to their softer nature, wherein the elastic slip-on portion of the handle pallet typically has a Shore A hardness of about 60. This outer handle pallet portion is either low pressure cast molded of polyurethane, or injection molded of KRATON ® rubber then slipped onto the handle in a subsequent manufacturing step. Whether the outer softer handle pallet portion is formed of polyurethane or KRATON ® rubber, either material is much heavier than the hard cell polyurethane foams which were previously the preferred material for forming the entire handle pallet, and therefore even less lead weight is necessary in order to obtain a head light balance condition. However, such racquet handles are deficient in that the indexability of the handle is significantly reduced due to the soft outer portion of the handle pallet. Moreover, such racquet handles also are too heavy for head heavy balance condition specifications. An example of such a racquet handle is shown in FIG. 1 and also is disclosed in U.S. Pat. Nos. 4,984,793 and 4,989,870.

Still another handle pallet design which has been in general use for several years is one in which the octagonal-shaped handle pallet has been simultaneously formed during the racquet compression molding operation. The composite racquet head tube is designed to form the handle pallet shape, therefore eliminating all ancillary operations which, as described above, were necessary to complete the handle pallet. Such a single step method yields a very hard handle pallet resulting in good indexing properties, and further yields a very lightweight handle suitable for head heavy balance condition specifications. However, such a handle typically results in complaints by many players that the handle transmits excessive shock to the player's hand. An example of such a racquet is shown in FIG. 2 and also is disclosed in U.S. Pat. No. 3,702,701.

Tennis racquet designers currently are attempting to solve another problem wherein the center of percussion is too low in the head of the racquet. In order to raise the center of percussion toward the distal end of the head of the tennis racquet, the racquet handles must be made lightweight in order to concentrate the majority of mass in the head area creating a head heavy balance condition. However, in order to aid in producing such a condition, a lightweight handle must be utilized, and as discussed above, the only currently available lightweight handle designs are very hard which, although providing good indexing, transmit undesirable levels of shock to the hand of the player.

SUMMARY OF THE INVENTION

Objects of the present invention include providing an improved tennis racquet handle which is lightweight so that the desired center of percussion of the racquet is maintained or improved, and which provides good indexing and shock absorption for the player.

Another object of the invention is to provide such a racquet handle in which the soft outer portion of the handle pallet resists displacement at its corners during play.

A further object of the invention is to provide such a racquet handle pallet which can be efficiently and economically manufactured, and which is durable in use.

These objects and advantages are obtained by the handle pallet for a racquet of the present invention, comprising, an elongated rigid underlayment member having a generally polygonal-shaped cross-section of from about 4 to about 10 sides, said sides each being formed with a pair of spaced elongated edges, with at least one of the sides having a generally concave-shaped exterior surface, and with the elongated edges of the concave shaped side each forming a prominent ridge at its interface with a respective adjacent elongated edge, and an elongated elastic overlayment member disposed about the underlayment member and having a generally polygonal-shaped cross-section of a number of sides corresponding to the number of sides of the underlayment member, the sides of the overlayment member each having a generally flat exterior surface, the overlayment member having an interior surface complementary in shape to the exterior surface of the underlayment member.

DETAILED DESCRIPTION OF THE DRAWINGS

Similar numerals refer to similar parts throughout the drawings.

DETAILED DESCRIPTION OF THE INVENTION

Figure 4:
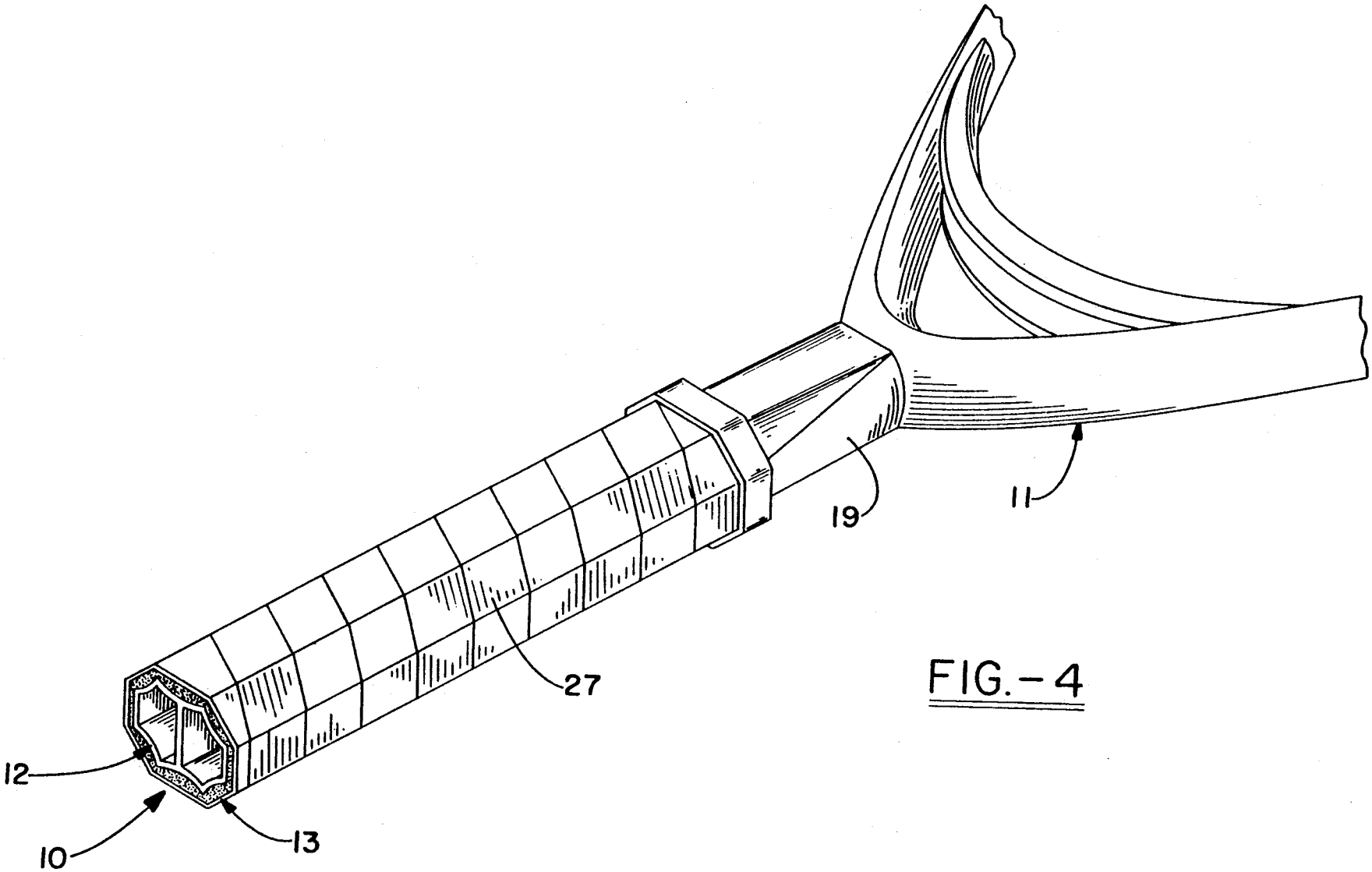
FIG. 4 is a view similar to FIG. 3, showing the soft overlayment member of the handle pallet of the present invention disposed on the underlayment member, and a plastic grip wrapped about the overlayment member.
Figure 5:
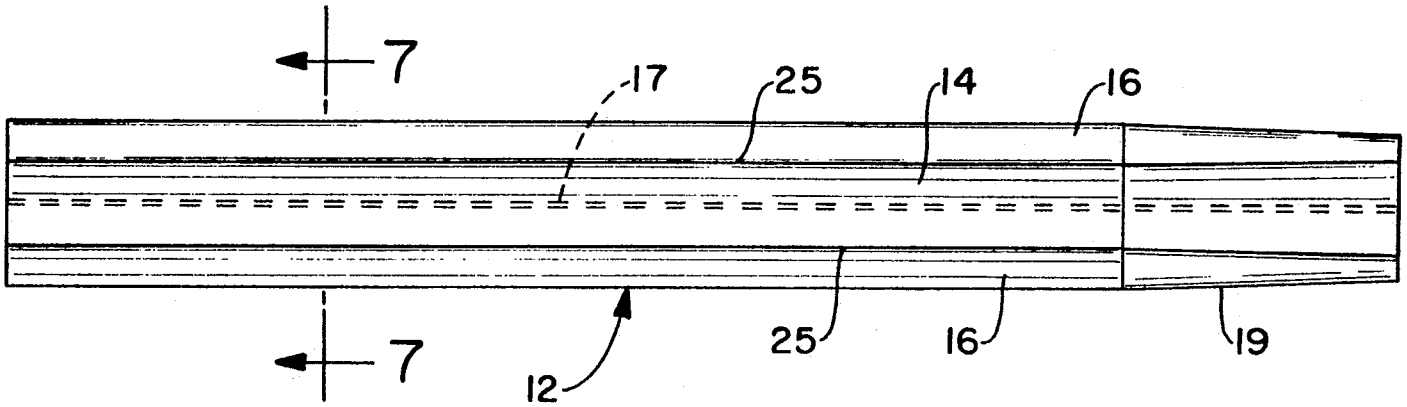
FIG. 5 is a plan view of the rigid underlayment member of the handle pallet.
Figure 6:
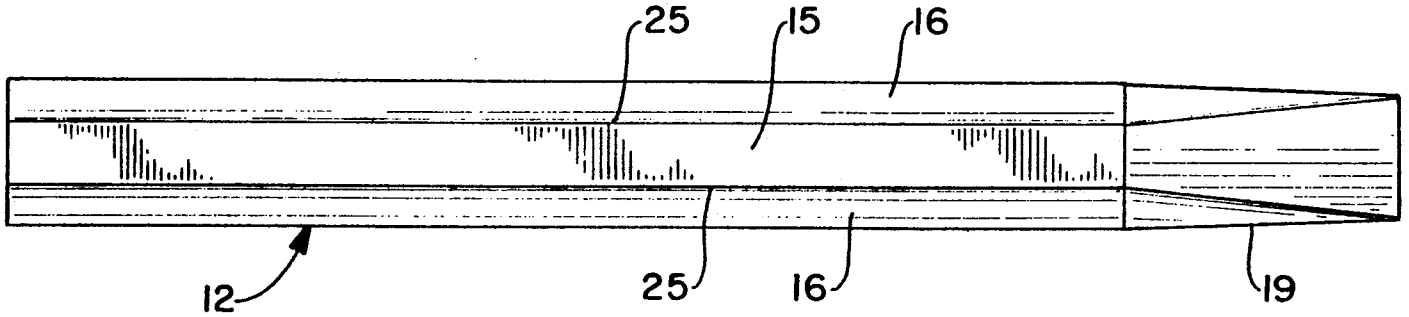
FIG. 6 is a side view of the handle pallet underlayment member shown in FIG. 5.
Figure 7A:
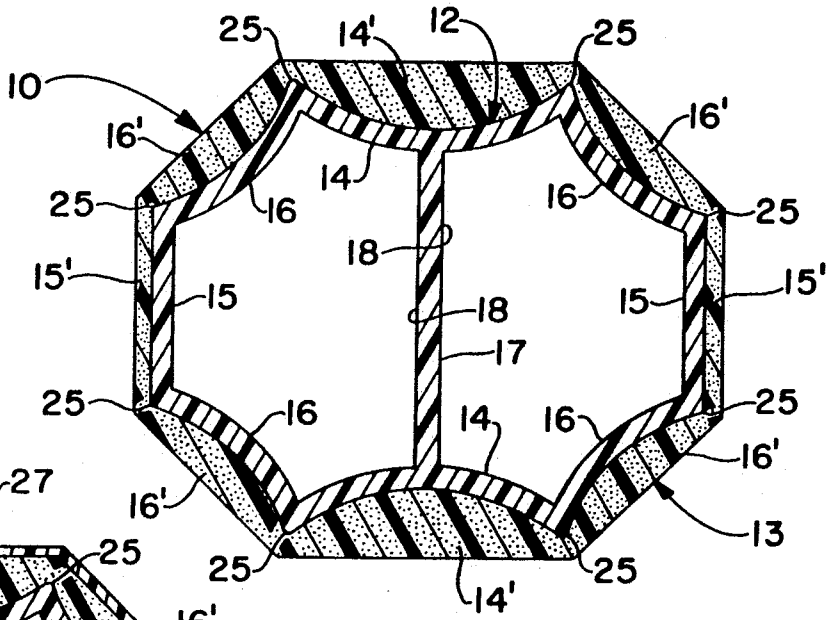
FIG. 7A is a transverse cross-sectional view of the handle pallet of the present invention.

The handle pallet of the present invention is indicated generally at 10 and is best shown in FIG. 7A, and is shown in its intended use in cooperation with a tennis racquet head or frame in FIG. 4. Handle pallet 10 includes a rigid underlayment member 12 and a soft or elastic overlayment member 13 disposed on the exterior surface of underlayment member 12.

More particularly, underlayment member 12 (FIG. 3, 5, 6, and 7) is an integral one-piece, elongated and generally hollow molded member which is formed during molding of tennis racquet head 11 in a single compression-molding operation, to form an integral one-piece handle pallet underlayment member/racquet head article. Rigid underlayment member 12 has a hardness, as measured on the Shore D scale, of at least 35 and preferably of at least 45. Underlayment member 12 preferably is formed of a plastic composite material, and most preferably an epoxy resin composite. Underlayment member 12 is generally octagonal-shaped and includes a pair of spaced apart opposed facial sides 14, a pair of spaced apart edge sides 15 which are arranged 90° from facial sides 14, and a plurality of corner sides 16 each of which extends between and interconnects a selected pair of the facial and edge sides. An integrally formed elongated wall 17 extends between and interconnects the midpoint of facial sides 14 for the entire longitudinal length of underlayment member 12 of handle pallet 10. Wall 17 divides the hollow portion of underlayment member 12, as defined by sides 14, 15, 16, into a pair of compartments 18, and is designed to provide support to member 12, and particularly to facial sides 14 thereof. As shown particularly in FIGS. 3–6, an end 19 of underlayment member 12 adjacent to racquet head 11 is tapered. This reduced perimeter end 19 of underlayment member 12 aids in lessening the overall weight of handle pallet 10. A larger perimeter end adjacent to racquet head ? i is unnecessary since handle pallet 10 typically is not grasped by a player in that area, and further, since the reduced perimeter underlayment member end 19 is sufficient to provide a strong connection of the handle pallet to the racquet head.

In accordance with one of the main features of the present invention, facial sides 14 and corner sides 16 of handle pallet underlayment member 12 each is concave-shaped, so that a prominent outwardly-facing radiused elongated ridge 25 is formed at the interface of each of the spaced elongated edges of corner sides 16 with an edge of its respective facial or edge side 14, 15, respectively. Edge sides 15 each is a linear flat side. The purpose of the particular structure of underlayment member 12 will be described in greater detail below.

Soft, shock-absorbing overlayment member 13 (FIGS. 4 and 7A) of handle pallet 10 is an integral one-piece elongated molded member which can either be directly molded onto underlayment member 12 in a low pressure cast molding step subsequent to the compression molding step which forms racquet head and the underlayment member, or injection or reaction injection molded in a step carried out remote from the underlayment member/racquet head and subsequently slipped on the underlayment member. In the latter slip-on method, although overlayment member 13 frictionally fits on underlayment member 12, a suitable adhesive is applied to the exterior surface of the underlayment member to aid in securing the overlayment member thereon. In addition, the concave-shaped sides of underlayment member 12 aid in preventing twisting of overlayment member 13 thereon during play. Soft or elastic overlayment member 13 has a Shore A hardness of from about 40 to about 80, desirably from about 55 to about 65, and preferably about 60. Overlayment member 13 preferably is formed of injection molded KRATON® elastomer or polyvinyl chloride, or reaction injection molded or cast molded polyurethane, with polyurethane being the material of choice. Overlayment member 13 is generally octagonal-shaped and includes a pair of spaced-apart opposed facial sides 14', a pair of spacedapart edge sides 15' which are situated 90° from facial sides 14', and a plurality of corner sides 16' each of which extend between and interconnect a selected pair of the facial and edge sides. As shown particularly in FIG. 7A, the interior surface of overlayment member 13 is complementary in shape to the form of the exterior surface of underlayment member 12, so that overlayment member 13 forms a tight, frictional fit with respect to underlayment member 12. The exterior surface of each of sides 14', 15', 16' of overlayment member 13 is linear and flat.

Figure 7B:
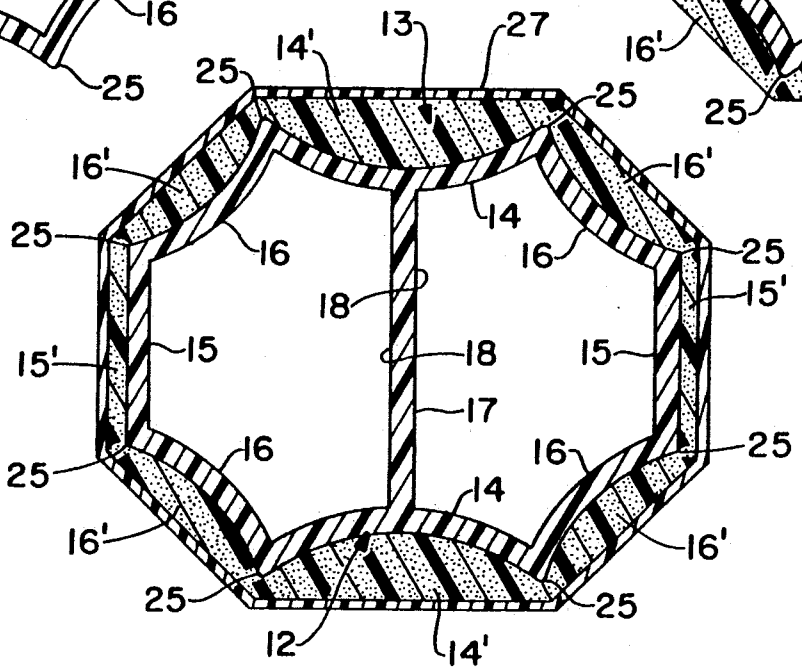
FIG. 7B is a transverse cross-sectional view of the handle pallet similar to that shown in FIG. 7A, and having a plastic grip wrapped thereon.
Figure 7:
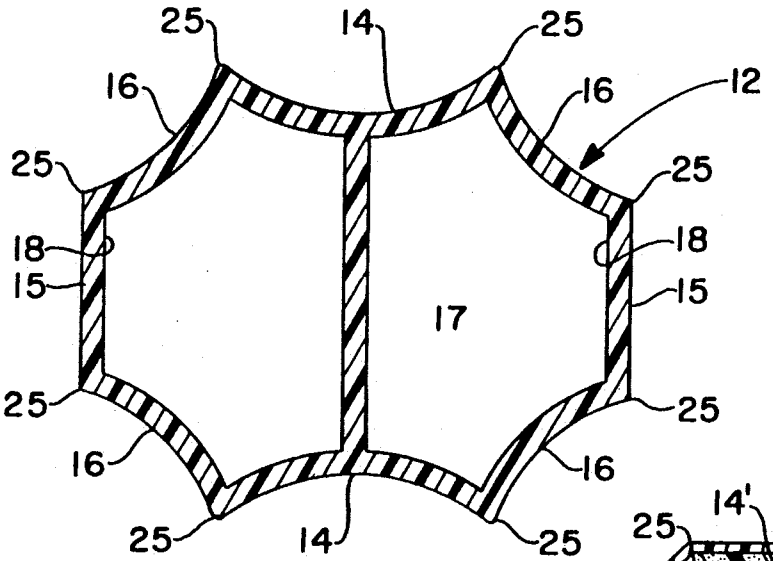
FIG. 7 is a sectional view taken on line 7—7, FIG. 5, showing the underlayment member of the handle pallet of the invention.

A plastic or leather grip 27 (FIGS. 4 and 7B) of a type which is well known to those having ordinary skill in the art, is wrapped on the exterior surface of overlayment member 13 in a well-known manner to provide a gripping surface for the hand of a tennis player. Grip 27 preferably is formed of polyurethane. It should be noted that overlayment member 13 and grip 27 extend only up to end 19 of underlayment member 12, since the shock absorbing and gripping functions, respectively, thereof are unnecessary on that portion of the underlayment member.

Figure 1:
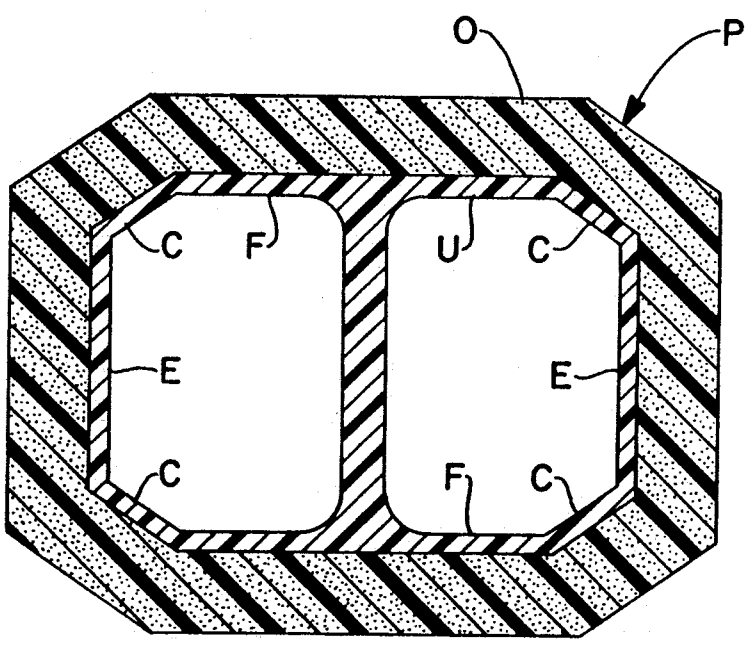
PRIOR ART FIG.-1
FIG. 1 is a transverse cross-sectional view of a prior art handle pallet of the type comprising a rigid generally octagonal-shaped plastic underlayment member, and an adhesively attached slip-on or low pressure cast-molded soft plastic complementary-shaped overlayment member.
Figure 3:
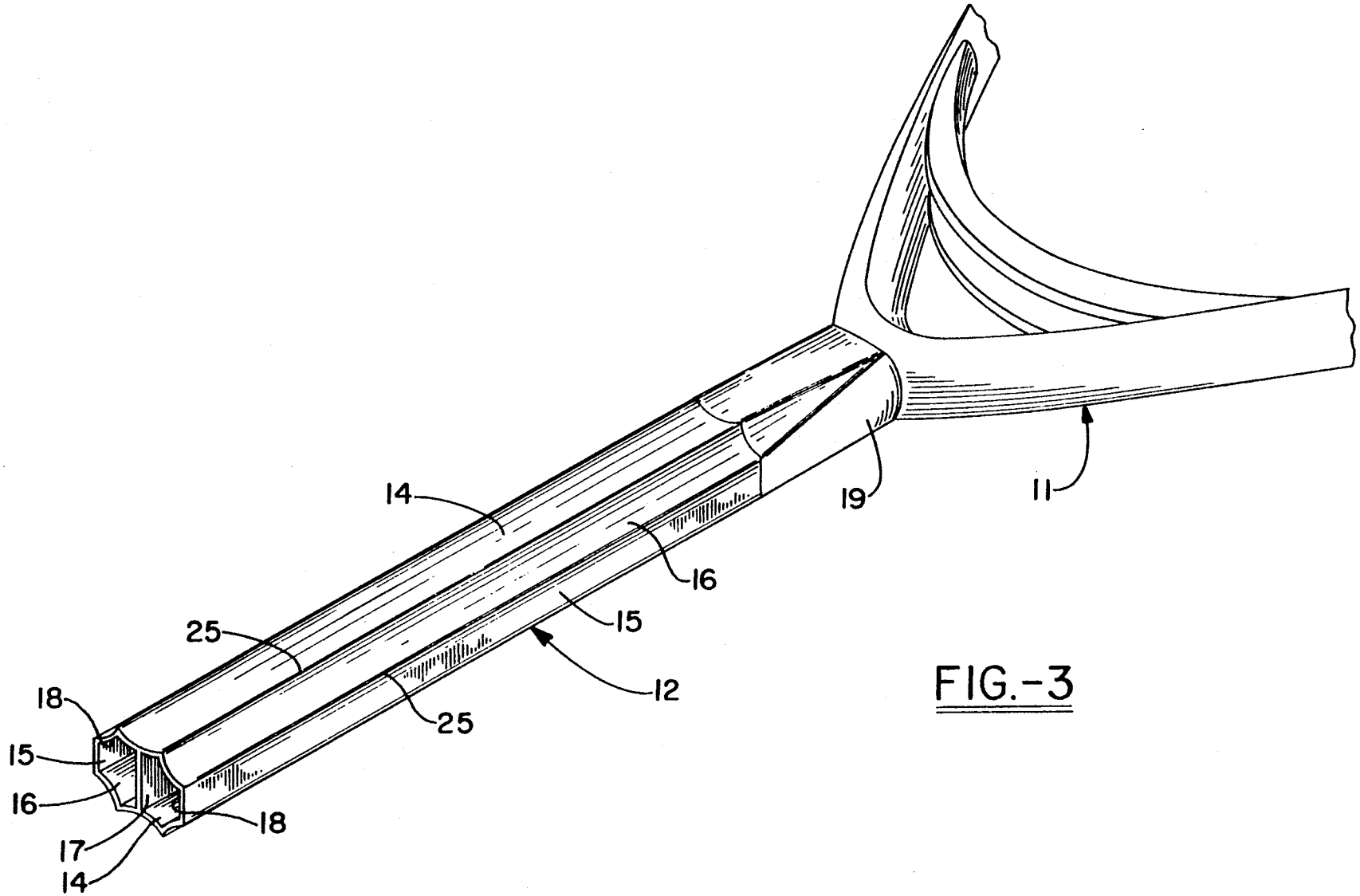
FIG. 3 is a fragmentary perspective view of the rigid underlayment member of the handle pallet of the present invention, shown formed integrally as a one-piece member with the racquet head.

In accordance with one of the main advantages of handle pallet 10 of the present invention, heretofore handle pallets of the type shown in FIG. 1 having improved shock absorption through the use of an exterior soft member have exhibited decreased indexing and excessive weight. The excessive weight is caused by the thick soft overlayment member 0 provided over relatively lightweight rigid underlayment member U of handle pallet P, as shown in FIG. 1. Although overlayment layer 0 provides absorption of shock for the player's hand, wherein the shock is caused by striking a tennis ball, the player loses the indexing feature typically provided by rigid octagonal-shaped underlayment portion U due to the thickness of elastic or soft overlayment layer 0 needed to absorb the shock. More particularly, spaced facial sides F of underlayment portion U should function to indicate to the player the orientation of the face of the racquet, while shorter length edge sides E should provide referencing with respect to the edges of the racquet. Of course, corner sides C are transitional and should also assist the player in indexing. However, the excessive thickness of soft layer 0 greatly diminishes the indexing function of layer U.

Figure 2:
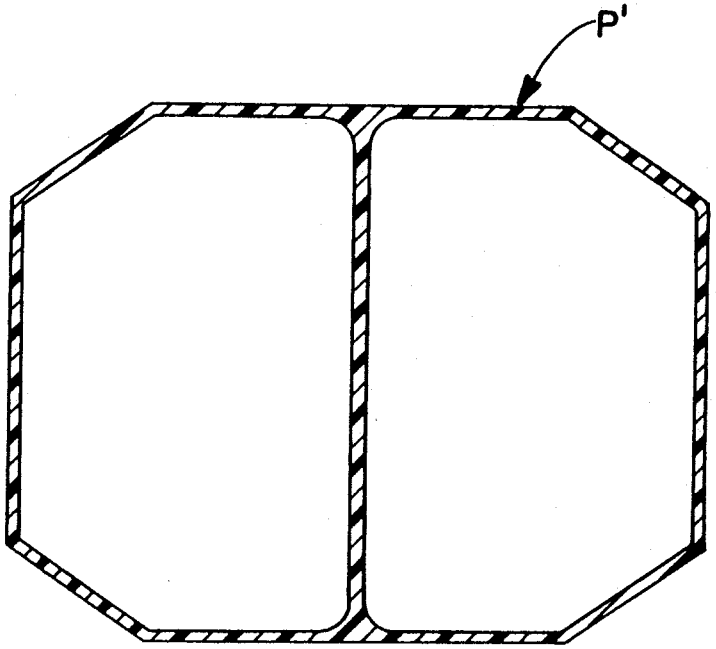
PRIOR ART FIG.-2
FIG. 2 is a transverse cross-sectional view of another prior art handle pallet comprising a generally octagonal-shaped rigid plastic handle pallet formed during the racquet compression molding operation.

As shown in FIG. 2, another typical prior art handle pallet P' simply is an octagonal-shaped rigid member, which is similar to underlayment portion U of handle pallet P which is shown in FIG. Although handle pallet P' shown in FIG. 2 is lightweight and provides excellent indexing properties, lack of an exterior soft member reduces its shock absorption capabilities which is undesirable for many tennis players, since the shock caused by striking a ball is transmitted directly to the player's hand.

In particular, the design of handle pallet 10 of the present invention provides a handle pallet having a unique combination of excellent shock absorption, excellent indexing, and which is lightweight. The above combination of highly desirable properties is accomplished by the design of handle pallet 10 in the following manner. The concave design of facial sides 14 and corner sides 16 of underlayment member 12, whereby prominent outwardly extending ridges 25 are formed at the interface of the ends of each corner side 16 with a certain pair of facial and edge sides 14 and 15, respectively, provides excellent indexing despite the presence of soft overlayment member 13. This is due to the fact that the concave/ridge structure of underlayment member 12 causes overlayment member 13 to be thickest in the areas of the handle pallet 10 where most players exert pressure with their hands and fingers to gain leverage, such as along facial sides 14 and corner sides 16, and therefore where shock is most likely to be transmitted to the player's hand. Overlayment member 13 conversely is thinnest in the areas where indexing is critical, namely along ridges 25 which protrude sharply into overlayment member 13 and where shock absorption is not critical, and along edges 15. This reduction in thickness at certain areas of handle pallet 10 by variable thickness overlayment member 13 while maintaining shock absorption, also results in an important overall reduction in weight of handle pallet 10. The indexing feature resulting from sharply defined ridges 25 allows a player to more easily locate his hand or hands for certain grips during play. It should be noted that flat edges 15 of underlayment member 12 facilitates demolding of the compression molded underlayment member.

It is understood that underlayment and overlayment members 12, 13 of handle pallet 10 of the present invention could be of any polygonal shape of from about four sides to about ten sides without affecting the concept of the present invention. Moreover, handle pallet 10 of the invention could be utilized in racquets other than tennis racquets, such as badminton racquets or racquetball racquets, again without affecting the concept of the invention.

While in accordance with the Patent Statutes, the best mode and preferred embodiment has been set forth, the scope of the invention is not limited thereto, but rather by the scope of the attached claims.

What is claimed is:

1. A handle pallet for a racquet, comprising:

an elongated rigid underlayment member having a generally polygonal-shaped cross-section of from about 4 to about 10 sides, said sides each being formed with a pair of spaced elongated edges, with at least one of said sides having a generally concave-shaped exterior surface, and with the elongated edges of said concave-shaped side each forming a prominent ridge at its interface with a respective adjacent elongated edge; said underlayment member being hollow; and an elongated elastic overlayment member disposed about said underlayment member and having a generally polygonal-shaped cross-section of a number of sides corresponding to the number of sides of said underlayment member, said sides of said overlayment member each having a generally flat exterior surface, said overlayment member having an interior surface complementary in shape to the exterior surface of said underlayment member, said overlayment member being formed of a material having a hardness less than that of the underlayment to provide for shock absorbance.

2. The handle pallet of claim 1, in which at least a first pair of opposite sides of said underlayment member are formed with a generally concave-shaped exterior surface; and in which said underlayment member is formed of a material having a Shore D hardness of at least about 35, and said overlayment member is formed of a material having a Shore A hardness of from about 45 to about 80.

3. The handle pallet of claim 2, in which a second pair of opposite sides of said underlayment member are formed with a generally flat exterior surface; and in which said overlayment member has a Shore A hardness of from about 55 to about 65.

4. The handle pallet of claim 3, in which said underlayment member has eight sides; in which said underlayment member has a generally uniform thickness and said overlayment member has a generally variable thickness; in which said underlayment member has a Shore D hardness of at least about 40 and said overlayment member has a Shore A hardness of about 60.

5. The handle pallet of claim 4, in which said underlayment member is formed of a plastic composite and said overlayment member is formed of a material comprising an elastomer or a plastic; and in which six sides of said underlayment member each have a concave-shaped exterior surface and two sides thereof each have a flat exterior surface.

6. The handle pallet of claim 5, in which said underlayment member is formed of an epoxy resin composite and said overlayment member is formed of a material comprising a styrene-butadiene elastomer, a polyvinyl chloride, or a polyurethane; in which said two sides of said underlayment member having a flat exterior surface are generally parallel to the edges of a racquet head, and in which two of said six sides of said underlayment member having a concave-shaped exterior surface are each disposed 90 degrees from said flat exterior surface sides and 180 degrees from each other and are generally parallel to the face of said racquet head; in which said two concave-shaped exterior surface sides generally parallel to the face of said racquet head are of equal length and have a length greater than the other six sides of said underlayment member which are of equal length; and in which an elongated support wall extends between and is integrally molded to the midpoints of said two extended length concave-shaped exterior surface sides of said underlayment member.

7. The handle pallet of claim 6, in which said overlayment member is formed of polyurethane; and in which said polyurethane overlayment member is low pressure cast molded on said underlayment member or reaction injection molded and frictionally fitted on and adhesively bonded to said separately molded underlayment member.

8. The handle pallet of claim 6, in which said overlayment member is injection molded of styrene-butadiene elastomer or polyvinyl chloride; and in which said overlayment member is frictionally fitted on and adhesively bonded to said separately molded underlayment member.

9. The handle pallet of claim 1, in which the underlayment member is hollow and wherein the prominent ridges of the underlayment member protrude sharply into the overlayment member.

10. The handle pallet of claim 9, in which the overlayment member is thickest at the sides of the handle pallet and thinnest along the sharply protruding ridges.

11. The handle pallet of claim 9, wherein said sharply protruding ridges are formed by the merging of adjacent outwardly concave sides.

12. The handle pallet of claim 11, wherein said hollow underlayment member includes a supporting wall disposed between opposed outwardly concave sides.

13. A tennis racquet, comprising:

a strung head or frame;

a handle including:

an elongated rigid underlayment member having a generally polygonal-shaped cross-section of from about 4 to about 10 sides, said sides each being formed with a pair of spaced elongated edges, with at least one of said sides having a generally concave-shaped side each forming a prominent ridge at its interface with a respective adjacent elongated edge, said underlayment member being hollow; and an elongated elastic overlayment member disposed about siad underlayment member and having a generally polygonal-shaped cross-section of a number of sides corresponding to the number of sides of said underlayment member, said sides of said overlayment member each having a generally flat exterior surface, said overlayment member having an interior surface complementary in shape to the exterior surface of said underlayment member, said overlayment member being formed of a material having a hardness less than that of the underlayment member to provide for shock absorbance.

14. The tennis racquet of claim 13, in which at least a first pair of opposite sides of said underlayment member are formed with a generally concave-shaped exterior surface; and in which said underlayment member is formed of a material having a Shore D hardness of at least about 35, and said overlayment member is formed of a material having a Shore A hardness of from about 45 to about 80.

15. The tennis racquet of claim 14, in which a second pair of opposite sides of said underlayment member are formed with a generally flat exterior surface; and in which said overlayment member has a Shore A hardness of from about 55 to about 65.

16. The tennis racquet of claim 15, in which said underlayment member has eight sides; in which said underlayment member has a generally uniform thickness and said overlayment member has a generally variable thickness; and in which said underlayment member has a Shore D hardness of at least about 40 and said overlayment member has a Shore A hardness of about 60.

17. The tennis racquet of claim 16, in which said underlayment member is formed of a plastic composite and said overlayment member is formed of a material comprising an elastomer or a plastic; and in which six sides of said underlayment member each have a concave-shaped exterior surface and two sides thereof each have a flat exterior surface.

18. The tennis racquet of claim 17, in which said underlayment member is formed of an epoxy resin composite and said overlayment member is formed of a material comprising a styrene-butadiene elastomer, a polyvinyl chloride, or a polyurethane; in which said two sides of said underlayment member having a flat exterior surface are generally parallel to the edges of the racquet head, and in which two of said six sides of said underlayment member having a concave-shaped exterior surface are each disposed 90 degrees from said flat exterior surface sides and 180 degrees from each other and are generally parallel to the face of said racquet head; in which said two concave-shaped exterior surface sides generally parallel to the face of said racquet head are of equal length and have a length greater than the other six sides of said underlayment member which are of equal length; in which an elongated support wall extends between and is integrally molded to the midpoints of said two extended length concave-shaped exterior surface sides of said underlayment member; in which a grip formed of a material comprising leather or polyurethane is wrapped on said overlayment member; and in which the lengths of said overlayment member and said grip are generally equal to each other and shorter than the length of said underlayment member.

19. The tennis racquet of claim 18, in which said overlayment member is formed of polyurethane; in which said polyurethane overlayment member is low pressure cast molded on said underlayment member or reaction injection molded and frictionally fitted on and adhesively bonded to said separately molded underlayment member.

20. The tennis racquet of claim 18, in which said overlayment member is injection molded of styrene-butadiene elastomer or polyvinyl chloride; and in which said overlayment member is frictionally fitted on and adhesively bonded to said separately molded underlayment member.

* * * * *